United States Patent [19]

Dodier

[11] Patent Number: 4,838,797

[45] Date of Patent: Jun. 13, 1989

[54] UNDERWATER CONNECT AND DISCONNECT PLUG AND RECEPTACLE

[75] Inventor: Paul J. Dodier, Rollinsford, N.H.

[73] Assignee: The United States of America as represented by the Secretary of the Navy, Washington, D.C.

[21] Appl. No.: 67,529

[22] Filed: Jun. 19, 1987

[51] Int. Cl.[4] ..... H01R 13/523

[52] U.S. Cl. ..... 439/38

[58] Field of Search ..... 439/38–40

[56] References Cited

U.S. PATENT DOCUMENTS

| | | | |
|---|---|---|---|
| 4,500,881 | 2/1985 | Beane | 439/38 |
| 4,538,863 | 9/1985 | Allen et al. | 439/39 |
| 4,669,792 | 6/1987 | Kjeldstad | 439/38 |

FOREIGN PATENT DOCUMENTS

| | | | |
|---|---|---|---|
| 5233092 | 12/1977 | Japan | 439/38 |

*Primary Examiner*—Joseph H. McGlynn

*Attorney, Agent, or Firm*—Arthur A. McGill; Prithvi C. Lall; Michael J. McGowan

[57] ABSTRACT

A plug and receptacle combination is transformer coupled. There are no exposed contacts to the environment at any time, whether the plug and receptacle combination are mated or separated from each other. By encapsulating the primary winding and secondary winding separately in a respective plug and receptacle, mating and unmating can be accomplished while submerged in water.

4 Claims, 1 Drawing Sheet

UNDERWATER CONNECT AND DISCONNECT PLUG AND RECEPTACLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention generally relates to electrical connectors and more particularly to an electrical connector assembly suitable to be connected and disconnected underwater. The inventive electrical connector assembly has no exposed contacts and is therefore safe to be handled when energized either in the connected or disconnected position.

(2) Description of the Prior Art

Prior art connector assemblies have been made watertight through various techniques so that after being connected they may be submerged. These watertight connectors have exposed pin or socket contacts upon being disconnected. It would not be feasible to energize either the plug or receptacle until they are suitably connected to each other.

SUMMARY OF THE INVENTION

A plug and receptacle are electrically connected through transformer action. The plug has a primary winding that is electrically energized. The receptacle has a secondary winding that upon mating coaxially encloses the primary winding and receives electrical energy through mutual induction for delivery to a load. If the load is to receive a higher voltage than the supply voltage the low voltage winding is the primary. If the load is to receive a lower voltage than the supply voltage the high voltage winding is the primary. In addition, the connector assembly can be designed to transfer an equal voltage from the primary to the secondary winding.

DESCRIPTION OF THE PREFERRED EMBODIMENT

Figure 1:
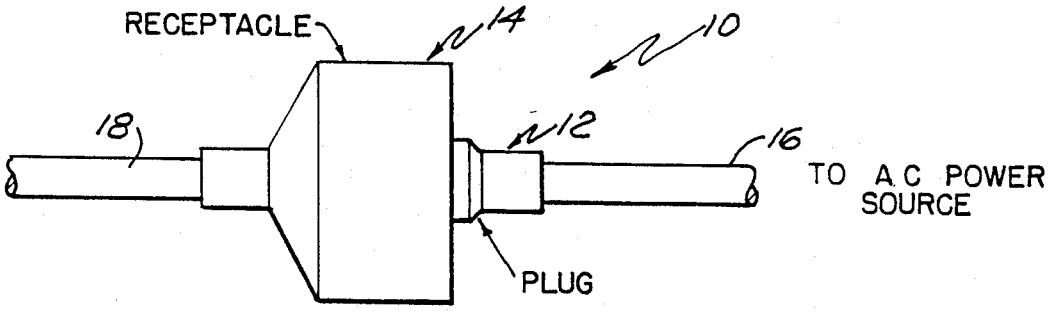
FIG. 1 is a view of the electrical connector assembly of the present invention.

Referring now to FIG. 1 there is shown a transformer 10 that has a plug 12 that inserts into a receptacle 14. The plug has an electrical cable 16 that receives an AC power source. The receptacle 14 has an electrical cable 18.

Figure 2:
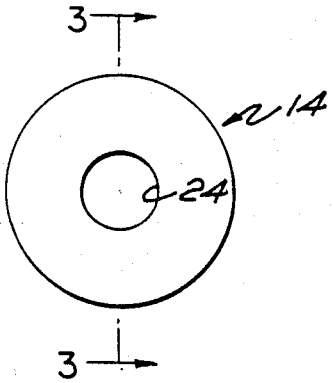
FIG. 2 is an end view of the receptacle shown in FIG.1.
Figure 3:
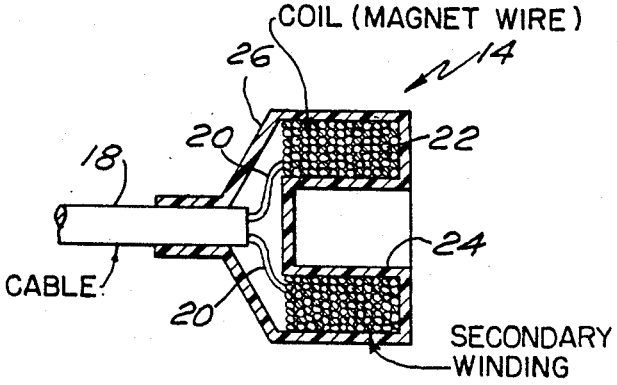
FIG. 3 is a cross-section of the receptacle taken along line 3—3 of FIG. 2.

FIG. 2 shows an end view of the receptacle 14. FIG. 3 shows a cross-sectional view of the receptacle 14 along the line 3—3 of FIG. 2 along with the associated cable 18. The cable 18 has a wire 20 that is formed into a coil (Magnet wire) 22 in the cylindrical portion 24 of receptacle 14. The receptacle covering 26 is a molded plastic material. A watertight seal is formed between covering 26 and cable 18. The coil 22 forms the secondary winding of the transformer 10, shown in FIG. 1.

Figure 4:
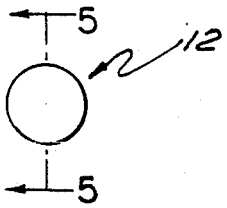
FIG. 4 is an end view of the plug shown in FIG. 1.
Figure 5:
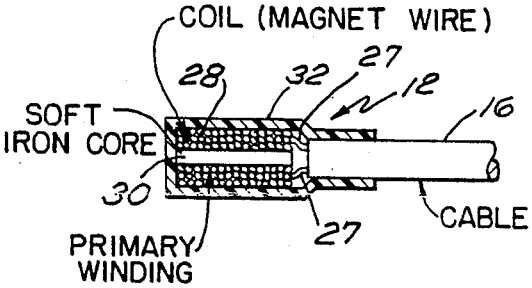
FIG. 5 is a cross-section of the plug taken along line 5—5 of FIG. 4.

FIG. 4 is an end view of the plug 12. FIG. 5 shows a cross-sectional view of the plug 12 along the line 5—5 of FIG. 4 along with the associated cable 16. The cable 16 has a wire 27 that is formed into a coil (magnet wire) 28. The coil 28 is wrapped around a soft iron core 30. The plug 12 covering 32 is a molded plastic material. A watertight seal is formed between covering 32 and cable 16. The coil 28 forms the primary winding of the transformer 10, shown in FIG. 1.

In operation the plug 12 is inserted into the receptacle 14 and through transformer action a voltage is induced in the secondary winding by electro-magnetic induction. The transformer 10 can be a constant potential, a step-up or a step-down transformer.

One modification of the device described would be to have soft iron used in lieu or in addition to some or all of the molded plastic for encapsulating the coils. The soft iron would provide a high conductive path for the magnetic field generated by the primary coil. Another modification would be the use of potting material to aid in maintaining watertight integrity between cables 16 and 18, and respective coverings 32 and 26.

The inventive device is useful in any underwater activity in which a diver must attach a power cable to a power driven tool, light, pump, etc., while submerged. In addition submarines could have the receptacles installed outboard of the pressure hull to be used in the event it became disabled at a depth attainable by a diver. A diver could descend with cables and plug them into the receptacles providing power and communications to the stranded crew awaiting rescue.

The invention could also be used in the home as a safety device where no voltage would be exposed. Either the plug or the receptacle shown could be built into the wall. Whichever item is built into the wall would receive the power source and have the primary winding.

It will be understood that various changes in details, materials, steps and arrangement of parts, which have been herein described and illustrated in order to explain the nature of the invention, may be made by those skilled in the art within the principle and scope of the invention as expressed in the appended claims.

What is claimed is:

1. A connector assembly unit comprising:

a first connector having a first transformer winding;

a second connector adapted to connect to and disconnect from said first connector, said second connector having a second transformer winding;

said first transformer winding and said second transformer winding form respective primary and secondary windings of the same transformer upon said first and second connectors being connected, and said first transformer winding and said second transformer winding are incapable of transformer coupling upon said first and second connectors being disconnected;

said primary winding is included in and completely enclosed in one of a plug and a receptacle, and said secondary winding is included in and completely enclosed in the other of said plug and said receptacle.

2. A connector assembly unit according to claim 1 wherein said plug has a soft iron core located on the same axis and interior to one of said primary and secondary windings.

3. A connector assembly unit according to claim 2 wherein said soft iron core, said primary winding and said secondary winding are all coaxial along the same segment of axis upon said plug and receptacle being mated.

4. A connector assembly unit according to claim 3 wherein each of said plug and receptacle are watertight in both the connect and disconnect modes.

* * * * *

UNITED STATES PATENT AND TRADEMARK OFFICE

CERTIFICATE OF CORRECTION

PATENT NO. : 4,838,797

DATED : Jun. 13, 1989

INVENTOR(S) : Paul J. Dodier

It is certified that error appears in the above-identified patent and that said Letters Patent is hereby corrected as shown below:

On the first page, delete

"[73] Assignee: The United States of America as represented by the Secretary of the Navy, Washington, D.C."

Signed and Sealed this

Twenty-fourth Day of April, 1990

*Attest:*

HARRY F. MANBECK, JR.

*Attesting Officer*

*Commissioner of Patents and Trademarks*